US006290393B1

(12) United States Patent
Tomic

(10) Patent No.: US 6,290,393 B1
(45) Date of Patent: Sep. 18, 2001

(54) SLIDER RECLOSABLE PACKAGES WITH DUAL PEEL SEALS

(75) Inventor: Mladomir Tomic, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/621,263

(22) Filed: Jul. 21, 2000

(51) Int. Cl.[7] ..... B65D 33/00

(52) U.S. Cl. ..... 383/210; 383/61; 383/64; 24/399

(58) Field of Search ..... 383/5, 61, 64, 383/210, 211; 24/399, 400

(56) References Cited

U.S. PATENT DOCUMENTS

| | | | | |
|---|---|---|---|---|
| 4,966,470 | | 10/1990 | Thompson et al. . | |
| 5,077,064 | | 12/1991 | Hustad et al. . | |
| 5,582,853 | | 12/1996 | Marnocha et al. . | |
| 5,669,715 | * | 9/1997 | Dobreski et al. | 383/64 X |
| 5,713,669 | | 2/1998 | Thomas et al. . | |
| 5,749,658 | | 5/1998 | Kettner . | |
| 5,924,795 | | 7/1999 | Thompson et al. . | |
| 5,938,337 | | 8/1999 | Provan et al. . | |
| 6,131,248 | * | 10/2000 | Tomic | 383/61 X |
| 6,183,134 | * | 2/2001 | Malin | 383/64 X |
| 6,186,663 | * | 2/2001 | Ausnit | 383/64 X |

FOREIGN PATENT DOCUMENTS 0 805 018 A2 11/1997 (EP) .

* cited by examiner

*Primary Examiner*—Jes F. Pascua

(57) ABSTRACT

A package, such as a flexible bag, having a resealable, reclosable zipper closure mechanism, opening and closing of which is accomplished by a slider device mounted on the zipper mechanism. A tamper-evident structure, such as a peel seal, is provided on the interior of the package between the zipper closure and the product retention volume. A second peel seal is provided between the zipper closure and environment surrounding the flexible package. Methods for making and using the dual peel seal zipper closure are described.

25 Claims, 6 Drawing Sheets

SLIDER RECLOSABLE PACKAGES WITH DUAL PEEL SEALS

FIELD OF THE DISCLOSURE

This disclosure concerns reclosable packages and their use. In particular, this disclosure describes zipper closures having peel seals, methods of making the zipper closures, and packages made with the zipper closure.

BACKGROUND

Flexible packages, in particular resealable and reclosable packages, are frequently used for packaging of consumable goods. Goods that are not used completely when the package is initially opened rely on a zipper closure to reclose the package and keep the remaining contents fresh. Examples of consumable goods that are often packaged in packages, such as bags with a zipper closure, include potting soil, fertilizer, pet food, dog biscuits, vegetables, cereal, and many different foods edible by humans.

Often, the opening and closing of the zipper closure is facilitated by a slider device that is mounted on the zipper closure. The slider device is constructed to pry apart the interlocking zipper closure members when the slider device is moved in a first direction along the zipper, and to engage the interlocking zipper closure members when the slider device is moved in a second, opposite direction along the zipper. For some applications, a tamper-evident structure, to notify whether access has been gained to the zipper closure, is desired. Improvements in these types of packages are desirable.

SUMMARY OF THE DISCLOSURE

Figure 1:
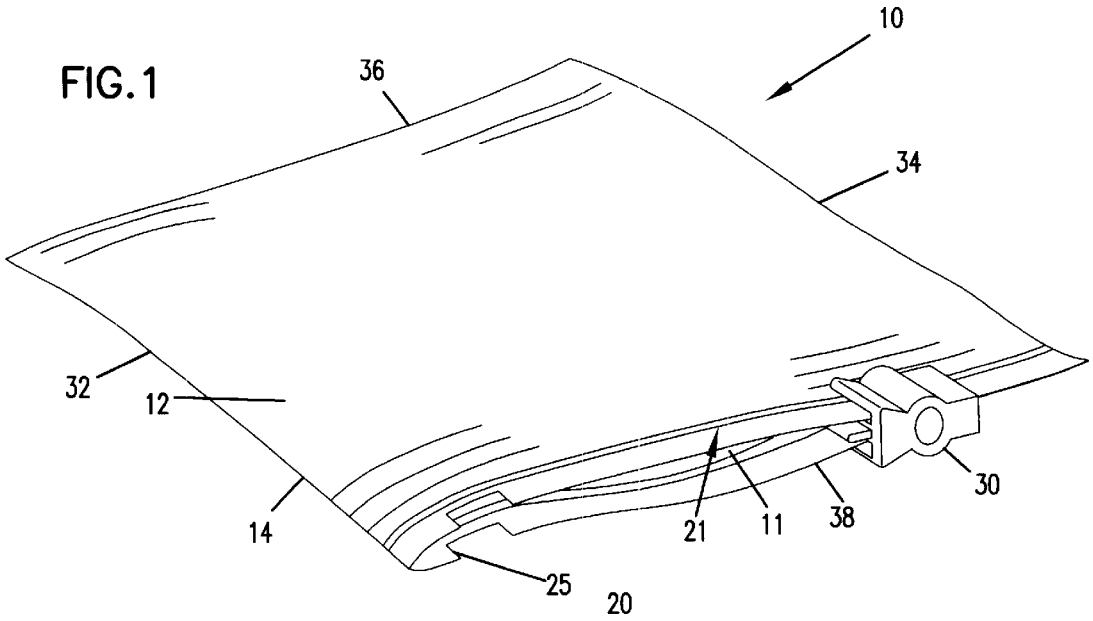
FIG. 1 is a perspective view of a flexible, reclosable package having a zipper closure and a slider device.

The present disclosure relates to a package, such as a flexible bag, having a resealable, reclosable zipper closure mechanism, opening and closing of which is accomplished by a slider device mounted on the zipper mechanism. A tamper-evident structure, such as a peel seal, is provided on the interior of the package between the zipper closure and the product retention volume. A second peel seal is provided between the zipper closure and environment surrounding the flexible package. The peel seals provide evidence whether access has been gained to the interior of the package. The peel seals may be a peelable film that is attached to the zipper closure after manufacturing of the zipper closure, or the peel seals may be provided on the zipper closure when the closure is manufactured.

In particular, the present disclosure is directed to a flexible, reclosable package including a package surrounding wall defining a package interior and a mouth. The mouth provides access to the package interior. The surrounding wall includes a first side panel and a second side panel opposite the first side panel. A reclosable zipper is along the mouth for selective opening and closing of the mouth. The zipper includes a first closure profile having a first sealing flange located at a first end of the first closure profile and a distal flange located at a second end of the first closure profile. The zipper also includes a second closure profile having a second sealing flange located at a first end of the second closure profile and a distal flange located at a second end of the second closure profile. The first and second sealing flanges each have first and second surfaces. A first sealant layer is disposed on the first surface of the first sealing flange and is secured to the first panel section, and a second sealant layer is disposed on the first surface of the second sealing flange and is secured to the second panel section. A first peel seal has first and second opposite outer surfaces. The first outer surface of the peel seal is secured to the second surface of the first sealing flange with a first seal strength. The second outer surface of the peel seal is secured to the second surface of the second sealing flange with a second seal strength. The first peel seal has an internal breaking strength that is less than each of the first seal strength and the second seal strength. A second peel seal has first and second opposite outer surfaces. The first outer surface of the peel seal is secured to the distal flange of the first closure profile with a first seal strength. The second outer surface of the peel seal is secured to the distal flange of the second closure profile with a second seal strength. The second peel seal has an internal breaking strength that is less than each of the first seal strength and the second seal strength. A slider device is operably mounted onto the reclosable zipper, the slider device interlocks the first closure profile with the second closure profile when the slider device is moved in a first direction, and disengages the first closure profile from the second closure profile when the slider device is moved in a second opposite direction.

In another embodiment, a flexible, reclosable package includes a package surrounding wall defining a package interior and a mouth. The mouth provides access to the package interior. The surrounding wall includes a first side panel and a second side panel opposite the first side panel. A reclosable zipper is along the mouth for selective opening and closing of the mouth. The zipper includes a first closure profile with a first sealing flange located at a first end of the first closure profile and a distal flange located at a second end of the first closure profile. The zipper also includes a second closure profile with a second sealing flange located at a first end of the second closure profile and a distal flange located at a second end of the second closure profile. The first and second sealing flanges each have first and second surfaces. A first sealant layer is disposed on the first surface of the first sealing flange and secured to the first panel section. A second sealant layer is disposed on the first surface of the second sealing flange and secured to the second panel section. A first peel seal has first and second opposite outer surfaces The first outer surface of the peel seal is secured to the first side panel with a first seal strength. The second outer surface of the peel seal is secured to the second side panel with a second seal strength. The first peel seal has an internal breaking strength that is less than each of the first seal strength and the second seal strength. A second peel seal has first and second opposite outer surfaces. The first outer surface of the peel seal is secured to the distal flange of the first closure profile with a first seal strength. The second outer surface of the peel seal is secured to the distal flange of the second closure profile with a second seal strength. The second peel seal has an internal breaking strength that is less than each of the first seal strength and the second seal strength. A slider device is operably mounted onto the reclosable zipper. The slider device interlocks the first closure profile with the second closure profile when the slider device is moved in a first direction, and disengages the first closure profile from the second closure profile when the slider device is moved in a second opposite direction.

In yet another embodiment, the disclosure is directed towards a zipper closure and methods for making and using the zipper closure. The zipper closure has a first closure profile with a first sealing flange located at a first end of the first closure profile and a distal flange located at a second end of the first closure profile. The zipper closure also includes a second closure profile with a second sealing flange located at a first end of the second closure profile and a distal flange located at a second end of the second closure profile. The first and second sealing flanges each have first and second surfaces. A first sealant layer is disposed on the first surface of the first sealing flange and secured to the first panel section, and a second sealant layer is disposed on the first surface of the second sealing flange and secured to the second panel section. A first peel seal has first and second opposite outer surfaces. The first outer surface of the peel seal is secured to the first side panel with a first seal strength. The second outer surface of the peel seal is secured to the second side panel with a second seal strength. The first peel seal has an internal breaking strength that is less than each of the first seal strength and the second seal strength. A second peel seal has first and second opposite outer surfaces. The first outer surface of the peel seal is secured to the distal flange of the first closure profile with a first seal strength. The second outer surface of the peel seal is secured to the distal flange of the second closure profile with a second seal strength. The second peel seal has an internal breaking strength that is less than each of the first seal strength and the second seal strength. A slider device is operably mounted onto the reclosable zipper. The slider device interlocks the first closure profile with the second closure profile when the slider device is moved in a first direction, and disengages the first closure profile from the second closure profile when the slider device is moved in a second opposite direction.

A zipper closure can be made by extruding a first closure profile. The first closure profile includes a first sealing flange, a first interlocking profile, and a first distal flange. A second closure profile is extruded. The second closure profile includes a second sealing flange, a second interlocking profile, the second interlocking profile constructed and arranged to interlock with the first interlocking profile, and a second distal flange. A first sealant layer is provided on the first sealing flange. A second sealant layer is provided on the second sealing flange. A first peel seal is provided on the first sealing flange opposite the first sealant layer. A second peel seal is provided on the first distal flange.

A zipper closure can be used by providing a package with an interior defined by a first side panel and a second side panel opposite the first side panel. The package has a mouth and a reclosable zipper arrangement for opening and closing the mouth. The zipper arrangement includes a first closure profile with a first sealing flange located at a first end of the first closure profile and a distal flange located at a second end of the first closure profile. The zipper arrangement also includes a second closure profile with a second sealing flange located at a first end of the second closure profile and a distal flange located at a second end of the second closure profile. The first and second sealing flanges each have first and second surfaces. A first sealant layer is disposed on the first surface of the first sealing flange and secured to the first panel section, and a second sealant layer is disposed on the first surface of the second sealing flange and secured to the second panel section. A first peel seal has first and second opposite outer surfaces. The first outer surface of the peel seal is secured to the second surface of the first sealing flange with a first seal strength. The second outer surface of the peel seal is secured to the second surface of the second sealing flange with a second seal strength. The first peel seal has an internal breaking strength that is less than each of the first seal strength and the second seal strength. A second peel seal has first and second opposite outer surfaces. The first outer surface of the peel seal is secured to the distal flange of the first closure profile with a first seal strength. The second outer surface of the peel seal is secured to the distal flange of the second closure profile with a second seal strength. The second peel seal has an internal breaking strength that is less than each of the first seal strength and the second seal strength. A slider device is operably mounted onto the reclosable zipper. The slider device interlocks the first closure profile with the second closure profile when the slider device is moved in a first direction, and disengages the first closure profile from the second closure profile when the slider device is moved in a second opposite direction. The first and second peel seals are penetrated.

DETAILED DESCRIPTION

Flexible packages having zipper closures are common in today's packaging market. Typically, the zipper closure has first and second interlocking closure profiles. The zipper closure provides easy opening and closing of the package mouth to gain access to the contents within the package interior. The addition of a tamper-evident structure, such as a peel seal, to a flexible package improves the security of the contents within the package because the tamper-evident structure provides an indication whether access has been gained to the interior.

The addition of a slider device to a flexible package, such as a bag, is advantageous to aging or arthritic persons not having the physical ability to use just a zipper closure to reseal a bag. Additionally, the addition of a slider device to a flexible package facilitates the use of the bag by users of all ages and abilities.

Flexible Reclosable Package

A flexible, reclosable package 10 is shown in FIG. 1. Package 10 has first and second polymeric film side panels 12 and 14 defining an interior 11. Package 10 includes three edges, side edges 32, 34 and bottom edge 36, where side panels 12, 14 are connected to each other to form interior 11 of package 10. First side edge 32 and second side edge 34 are seals created by the application of heat and pressure for a set time period to side panels 12, 14. In an alternate embodiment, at least one of first side edge 32 and second side edge 34 is a fold line, where a single sheet of film is folded to form the two side panels 12, 14.

In FIG. 1, bottom edge 36 is a fold line between side panels 12, 14, which is formed when a single sheet of film is folded to form the two side panels; in another embodiment, bottom edge 36 is a seal created by the application of heat and pressure to side panels 12, 14 for a desired time period. Bottom edge 36 can include a gusset (not shown). A gusset can be included to provide the package with a stand-up feature or to increase the volume of interior 11. The gusset may be a sealed gusset, where the two sides are sealed together along the length of the gusset or only a portion of the length, or the gusset panels may be non-sealed.

Throughout this disclosure, the side of the package having the bottom edge 36 will be referred to as the "bottom" of the package, and the side having the zipper closure 20 will be referred to as the "top" of the bag. It is understood that package 10 can be oriented so that bottom edge 36 is not positioned below zipper closure 20; nevertheless, the reference for "top" at the zipper closure remains.

A mouth 21 provides access to interior 11 of package 10 along the top of the package. A zipper closure 20 extends from first side edge 32 to second side edge 34. The zipper closure 20 can include a variety of configurations and structures.

A slider device 30 is mounted on zipper closure 20 to facilitate opening and closing of zipper closure 20. Slider devices and how they function to open and close zipper closures, in general, are taught, for example, in U.S. Pat. Nos. 5,063,644; 5,301,394; 5,442,837, and 5,664,329, each of which is incorporated by reference herein. A preferred slider device is taught in U.S. patent applications Ser. No. 09/365,215 and 29/108,657, both filed Jul. 30, 1999, and incorporated herein by reference in their entirety. Although shown schematically in FIGS. 1, 3–5 and 8, slider device 30 is preferably constructed and arranged in accordance with the disclosures of patent applications Ser. No. 09/365,215 and 29/108,657.

Still referring to FIG. 1, a notch 25 can be disposed within zipper closure 20. Notch 25 is designed to provide a "park place" into which slider device 30 settles when zipper closure 20 is sealed. Such a notch 25 may decrease any tendency for an incomplete interlock between first closure profile 22 and second closure profile 24. Preferably, the notch 25 is such a depth as to leave at least a portion of the second peel seal 140 (discussed below) disposed on the distal flange 127, 129 intact Examples of notches are disclosed, for example, in U.S. Pat. Nos. 5,067,208 and 5,301,395, each of which is incorporated by reference herein.

Zipper Closure

A zipper closure arrangement 20 having mating closure profiles to open and close (unseal and reseal) first and second side panels 12, 14 of package 10 extends between side edge 32 and side edge 34 along top edge 38 of package 10. Zipper closure 20 opens and closes mouth 21 that provides access to interior 11. A slider device 30 is positioned on zipper closure 20 to facilitate opening and closing of zipper closure 20 at mouth 21.

Figure 2:
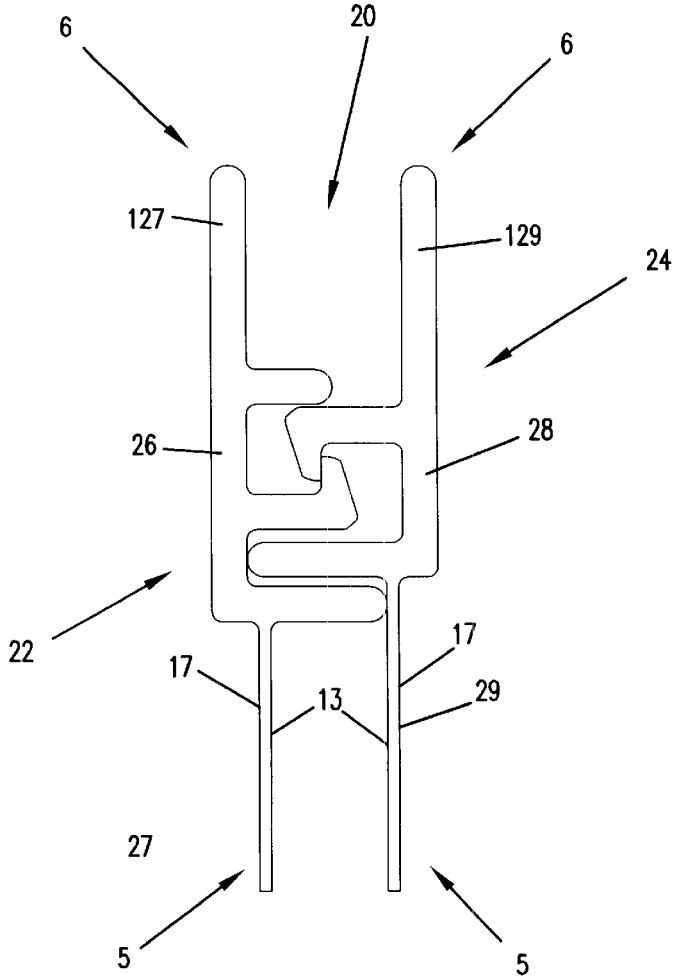
FIG. 2 is a cross-sectional, close-up view of the zipper closure, without the slider device disposed thereon.

Referring again to zipper closure 20, zipper closure 20 can include a variety of configurations and structures. In FIG. 2, zipper closure 20 is shown in detail without slider device 30. Zipper closure 20 has a first closure profile 22 and a second closure profile 24. In particular, first closure profile 22 has first interlocking profile 26 and second closure profile 24 has second interlocking profile 28. First and second interlocking profiles 26, 28 are arranged and constructed to interlock and provide a seal across mouth 21 (FIG. 1).

First and second closure profiles 22, 24 include first and second sealing flanges 27, 29, at a first end 5 that extend from interlocking profiles 26, 28 and that are provided to secure closure profiles 22, 24 to side panels 12, 14. First and second sealing flanges 27, 29 have an inner first surface 13 and an outer second surface 17.

First and second closure profiles 22, 24 also include first and second distal flanges 127, 129, that extend from interlocking profiles 26, 28 at a second end 6 that extend from interlocking profiles 26, 28. Preferably, interlocking profiles 26, 28 are located between first end 5 and second end 6.

Zipper closure 20 can be configured in any known manner, for example, such as disclosed in U.S. Pat. Nos. 4,340,341; 4,346,288; and 4,437,293; each of which is incorporated by reference herein. First closure profile 22 and second closure profile 24 engage and disengage, as appropriate, to open and close package 10.

Tamper Evident Structure

Figure 3:
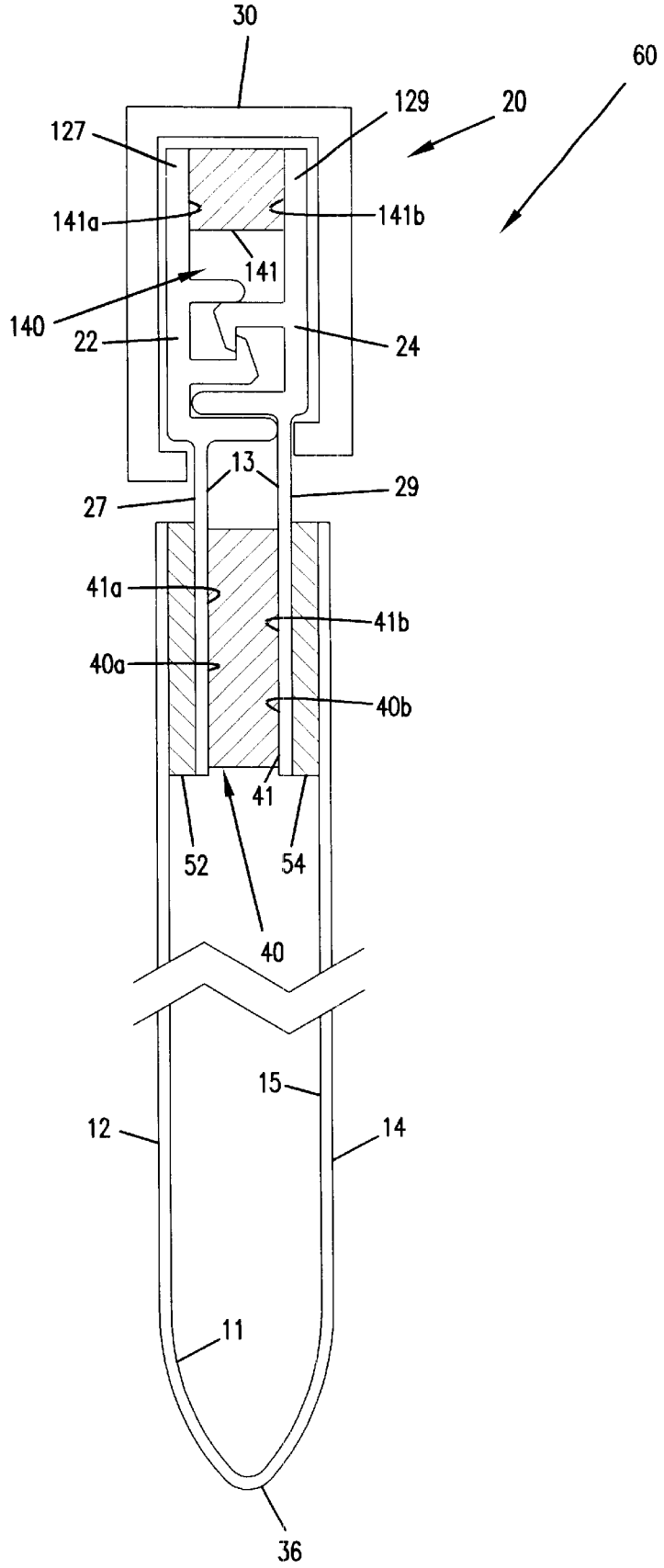
FIG. 3 is a cross-sectional view of a first embodiment of a flexible, reclosable package having dual peel seals.

Referring now to FIG. 3, a first peel seal 40 is disposed within package 60; in particular, first peel seal 40 in FIG. 3 is disposed on and secured to interior or first surface 13 of sealing flanges 27, 29 of zipper closure 20. A second peel seal 140 is disposed within package 60; in particular, second peel seal 140 in FIG. 3 is disposed on and secured to distal flange 127, 129 of zipper closure.

Peel seals 40, 140 are tamper-evident structures; by "tamper-evident", it is meant that it provides an indication to the consumer as to whether the package 60 has been previously opened and access gained to the interior 11. Peel seals 40, 140 extend from first side edge 32 (FIG. 1) to second side edge 34 (FIG. 1), providing a barrier between zipper closure 20 and interior 11 of the package and between the interior 11 and the environment surrounding the package 60. Preferably, the peel seals 40, 140 are continuous from first side edge 32 to second side edge 34; however, peel seals 40, 140 may be intermittent along this length.

A permanent bond or seal exists between first peel seal 40 and sealing flanges 27, 29 at outer surfaces 40*a*, 40*b* and second peel seal 140 and distal flanges 127, 129 at outer surfaces 140*a*, 140*b*. The strength of these bonds or seals are typically measured by the force needed to break the bonds. In order to access interior 11 of package 60, both peel seals 40, 140 need to be penetrated.

Both peel seals 40, 140 have an internal strength that is less than the strength of the seals between first peel seal 40, and sealing flanges 27, 29 at outer surfaces 40*a*, 40*b* and between second peel seal 140, and sealing flanges 127, 129 at outer surfaces 140*a*, 140*b*. By "internal strength", it is meant that a certain force is needed to rupture, cleave, split, delaminate, or otherwise separate peel seal 40, 140 within the structure of peel seal 40, 140 between outer surfaces 40*a*, 40*b*, 140*a*, 140*b*. Since there is a tendency to break at the weakest point, peel seal 40, 140 will cleave internally, within itself, rather than at the areas where peel seal 40, 140 is secured to sealing flange 27, 29 or distal flange 127, 129. Thus, upon penetration of peel seal 40, 140, peel seal 40, 140 will split internally, leaving a portion of peel seal 40, 140 connected to each sealing flange 27, 29 and distal flange 127, 129 at surfaces 40*a*, 40*b* and 140*a*, 140*b*.

In particular, peel seal 40, 140 is a peelable film 41, 141. A "peelable film" generally includes multiple layers, typically 2 to 5 layers, which, when a force of a predetermined magnitude is applied, delaminates or otherwise splits between at least two of the multiple layers. This delamination between two layers is internal to the overall peelable film 41, 141. However, if one of the layers tears within itself, this is also considered an internal split. The various layers of peelable films may be made from different or the same polymeric materials. For example, a peelable film with two layers can have both layers made from the same material; or, the two layers can be made from different materials.

In one embodiment, the multiple layers of peelable film 41, 141 are provided simultaneous during extrusion of the peelable film; that is, the layers of peelable film 41, 141 are co-extruded. In another embodiment, individual layers are laminated together to provide peelable film 41, 141. The internal bonding strength between and/or within the multiple layers, whether co-extruded or laminated, is generally less than the bonding strength between the outer surfaces 41*a*, 41*b*, 141*a*, 141*b* of peelable film 41, 141 and other polymeric surfaces such as sealing flanges 27, 29, distal flanges 127, 129 pr side panels 12, 14.

In package 60, outer surfaces 41*a*, 41*b*, of peelable film 41 provide a strong seal to sealing flanges 27, 29 and outer surfaces 141*a*, 141*b*, of peelable film 141 provide a strong seal to distal flanges 127, 129. When peelable film 41, 141 of package 60 is breached, peelable film 41, 141 delaminates or tears internally, either between two layers or within a single layer, while leaving the seal between outer surfaces 41*a*, 41*b* and sealing flanges 27, 29 intact and leaving the seal between outer surfaces 141*a*, 141*b* and distal flanges 127, 129 intact.

Figure 4:
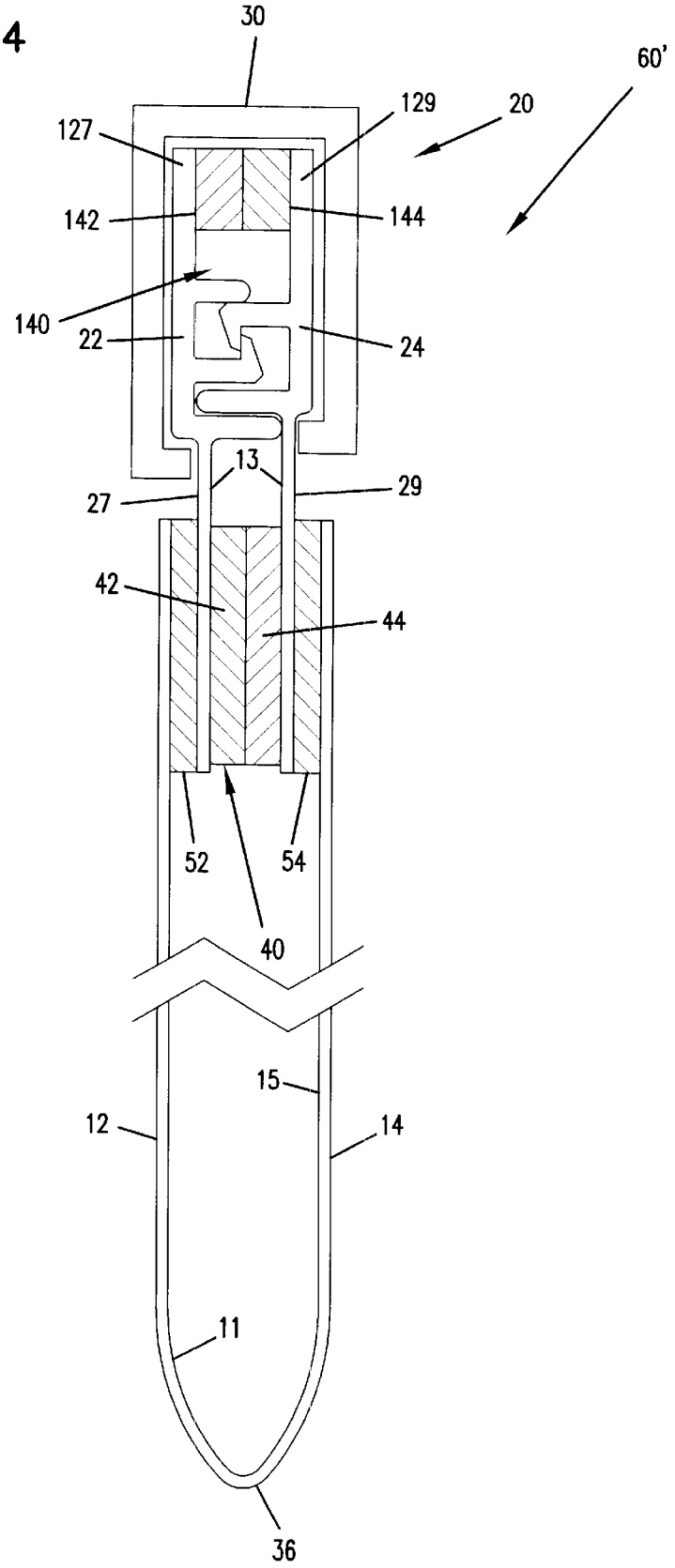
FIG. 4 is a cross-sectional view of a second embodiment of a flexible, reclosable package having dual peel seals.

In FIG. 4, package 60' is similar to package 60 of FIG. 3, except that package 60' has first peel seal 40, with first and second portions, 42,44 and second peel seal 140 with first and second portions, 142, 144. First portion 42 is sealed to first sealing flange 27, and second portion 44 is sealed to second sealing flange 29; first portion 42 and second portion 44 are also sealed to each other. First portion 142 is sealed to first distal flange 127, and second portion 144 is sealed to second distal flange 129; first portion 142 and second portion 144 are also sealed to each other. Typically, first and second portions 42,44, 142, 144 are the same material; however, in some embodiments, first and second portions 42,44, 142, 144 are different. When first peel seal 40, having first and second portions 42,44, is breached, first portion 42 and second portion 44 delaminate from each other, leaving the seals to sealing flanges 27, 29 intact.

When second peel seal 140, having first and second portions 142, 144, is breached, first portion 142 and second portion 144 delaminate from each other, leaving the seals to distal flanges 127, 129 intact. The seal strength between first portion 42, and sealing flange 27, and the seal strength between second portion 44 and sealing flange 29, are greater than the seal strength between first portion 42 and second portion 44. Likewise, the seal strength between first portion 142, and distal flange 127, and the seal strength between second portion 144 and distal flange 129, are greater than the seal strength between first portion 142 and second portion 144.

Sealant Structure

Package 60 also includes sealant layer 52, 54, which provide a permanent seal or bond between side panels 12, 14 and sealing flanges 27, 29, respectively. Interior surface 15 of side panels 12, 14 surrounds interior 11 and is secured to sealant layers 52, 54. Sealant layer 52, 54 is secured to outer or second side 17 of sealing flange 27, 29.

Sealant layer 52, 54 can be provided on sealing flanges 27, 29 after first and second closure profiles 22, 24 have been manufactured; or, sealant layer 52, 54 can be co-extruded with closure profiles 22, 24. Sealing layers 52, 54 are typically activated, to bond sealing flanges 27, 29 to side panels 12, 14, by the application of heat and pressure over time. In order to form the bond between sealing flanges 27, 29 and side panels 12, 14, sealing layers 52, 54 preferably have a melting point that is less than the melting point of both sealing flanges 27, 29 and side panels 12, 14. In one embodiment, the material used for sealant layers 52, 54 has a melting point of no greater than about 130° C.; in another embodiment, the material used for sealant layers 52, 54 has a melting point of no greater than about 110° C. Examples of materials that can be used as sealant layers include EVA (ethylene-vinyl acetate copolymer), EMMA (ethylene methyl acetic acid), and ionomers. Additional examples of usable materials are taught in U.S. Pat. No. 5,709,915 (Tomic et al.), incorporated herein by reference.

The sealing layers 52, 54 can be directly opposite of each other or can be offset. For instance, first sealing layer 52 can be located at a point lower on first sealing flange 26 than second sealing layer 54 on second sealing flange 29, or vice versa. The sealing layers 52, 54 may also have widths that are dissimilar or offset. Offset sealing layers 52, 54 allow the sealing structure to act as a hinge type arrangement and as discussed below.

Figure 5:
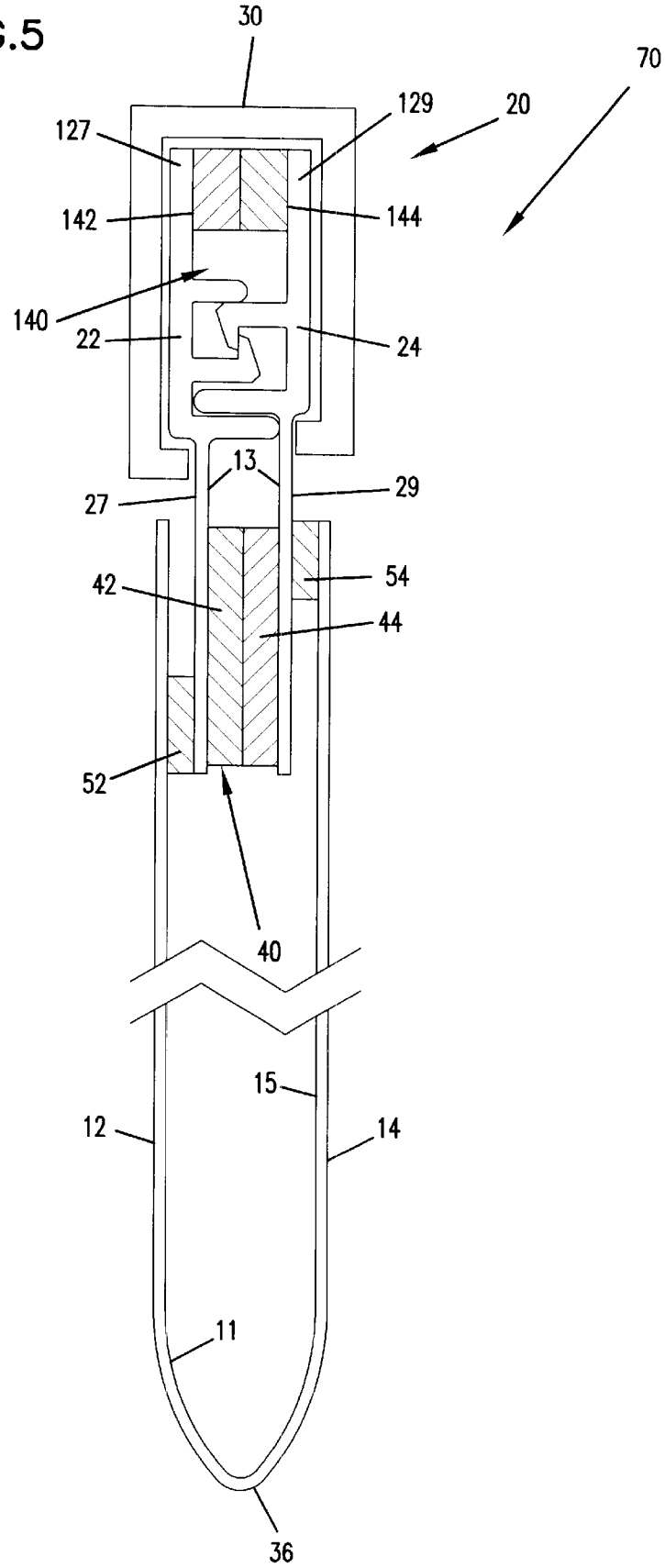
FIG. 5 is a cross-sectional view of a third embodiment of a flexible, reclosable package having dual peel seals.

Referring now to FIG. 5, package 70 of FIG. 5 is similar to package 60' of FIG. 4, except that package 70 has offset sealant layers 52, 54 bonding sealing flanges 27, 29 to side panels 12,14. Offset sealant layer 54, in addition to bonding sealing flange 29 to side panel 14, provides a hinge-type structure 56. The seal at sealant layer 54 may be made simultaneously with, or separate from, the seal at sealing layer 52. The hinge 56 is arranged and configured to increase the holding force of the resealable closure mechanism 20. Further, hinge 56 removes a portion of the stress on first peel seal 40 when package 70 has items within interior 11. An example of a hinged arrangement 56 is disclosed, for example, in U.S. patent application Ser. No. 09/107,859, filed Jun. 30, 1998, and incorporated herein by reference. A hinge-type structure 56 can be positioned at each of side panels 12, 14. Generally, hinge-type structures 56 are used when packages 70 are filled through their bottoms, that is, bottom edge 36 of the package 70 opposite zipper closure 20; a hinge-type structure 56 minimizes the stress on first peel seal 40 when the items are dropped onto first peel seal 40.

Figure 6:
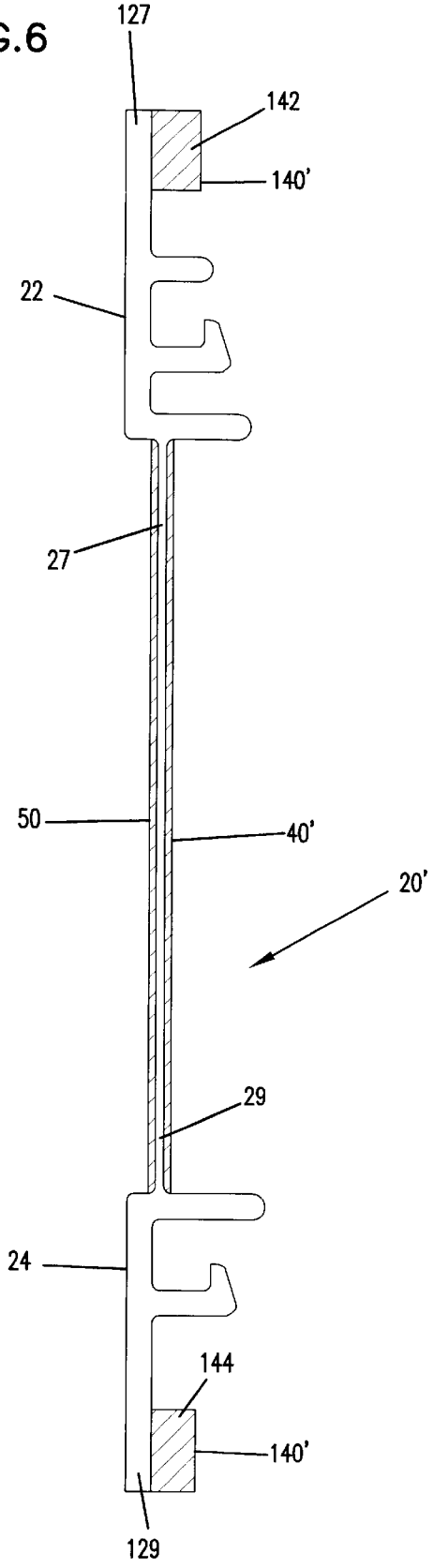
FIG. 6 is a cross-sectional view of one embodiment of first and second closure profiles of a zipper closure usable with any of the embodiments of dual peel seals of FIGS. 1–5.
Figure 7:
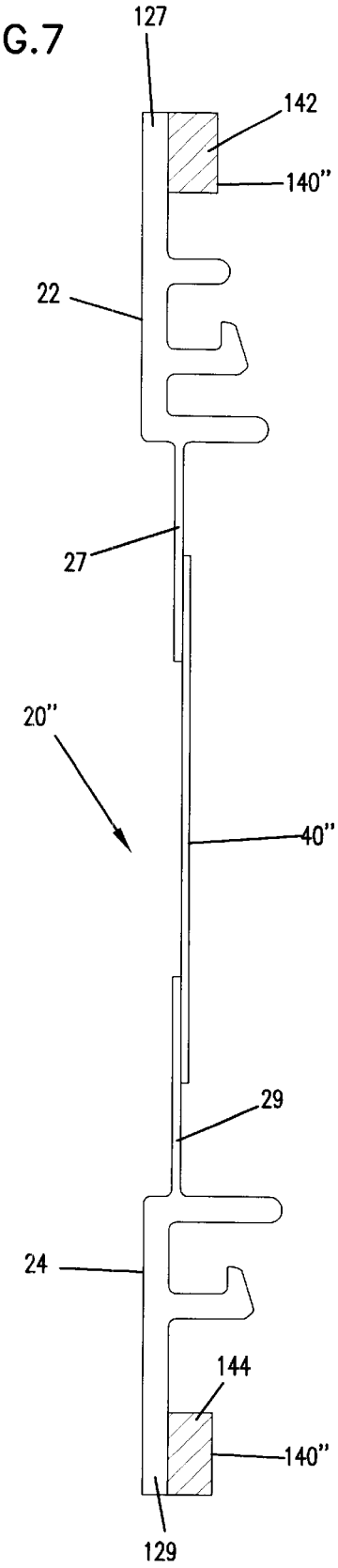
FIG. 7 is a cross-sectional view of a second embodiment of first and second closure profiles of a zipper closure usable with any of the embodiments of dual peel seals of FIGS. 1–5.

FIGS. 6 and 7 show embodiments of zipper closures 20' and 20" prior to being incorporated into a package. Referring to FIG. 6, zipper closure 20' has first closure profile 22 and second closure profile 24 connected together at sealing flanges 27, 29. Zipper closure 20' can be extruded as a single piece, as shown in FIG. 6, and then slit to two separate pieces prior to incorporation into a package. In FIG. 6, sealing flanges 27, 29 have disposed thereon first peel seal layer 40' and sealant layer 50. First peel seal 40' and sealant layer 50 extend the length of sealing flanges 27, 29. Distal flanges 127, 129 have disposed thereon second peel seal layer 140'.

First peel seal layer 40' and sealant layer 50 can be provided on sealing flanges 27, 29 and second peel seal layer 140' can be provided on distal flanges 127, 129 during extrusion of closure profiles 22, 24; that is, the layers 40', 140', and 50 can be co-extruded with the closure profiles 22, 24. Alternately, first peel seal layer 40', second peel seal layer 140' or sealant layer 50, can be coated onto formed closure profiles 22, 24.

In FIG. 7, sealing flanges 27, 29 are not contiguous; rather, sealing flanges 27, 29 are connected by a self-supporting first peel seal layer 40". First peel seal layer 40" can be attached to sealing flanges 27, 29 after closure profiles 22, 24 are extruded, or, first peel seal layer 40" can be co-extruded with closure profiles 22, 24. First peel seal layer 40", one that extends between and connects sealing flanges 27, 29, will generally be a peelable film. Second peel seal layer 140" is formed on closure profiles 22, 24 as described above.

Figure 8:
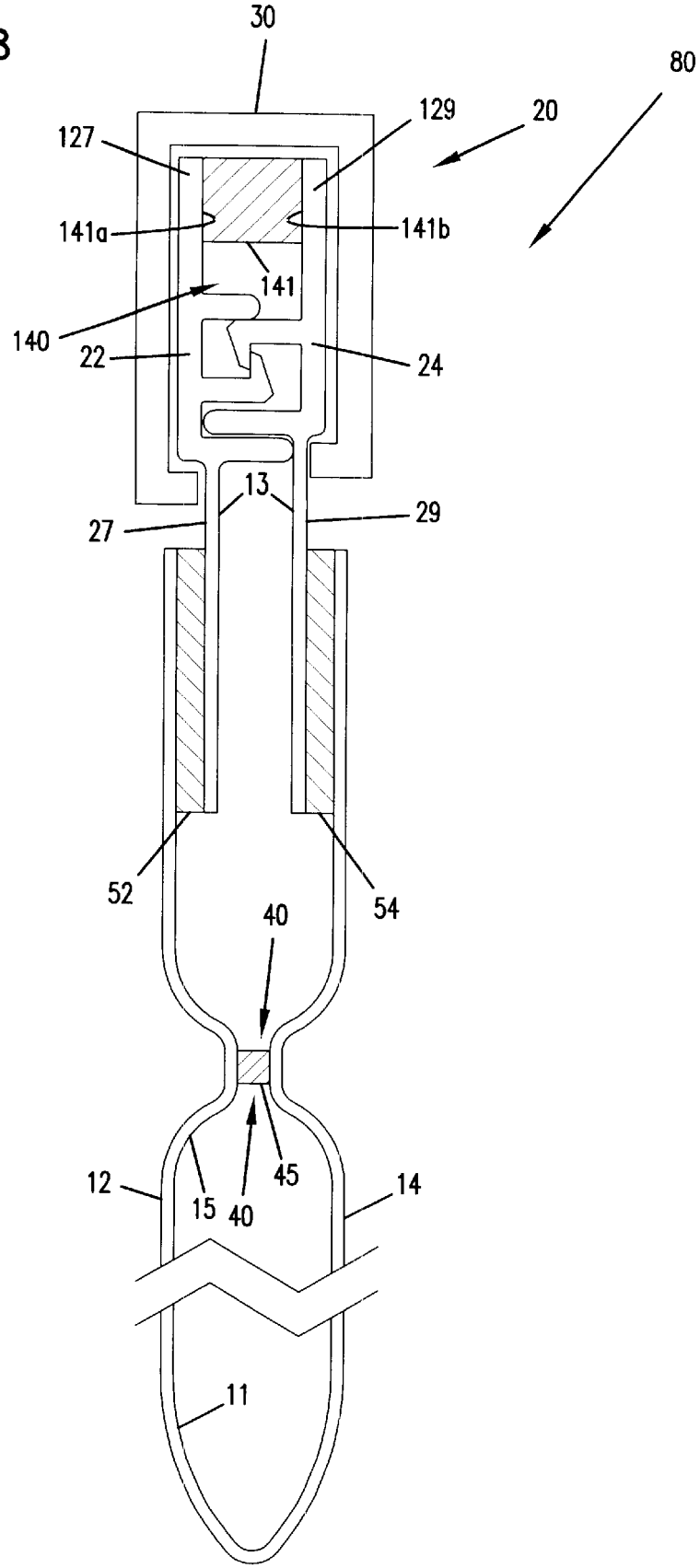
FIG. 8 is a cross-sectional view of a fourth embodiment of a flexible, reclosable package having dual peel seals.

Yet another embodiment of a flexible, reclosable package is shown in FIG. 8. Package 80 of FIG. 8 has first and second side panels 12, 14 that define an interior 11. A zipper closure 20, having first and second closure profiles 22, 24, is sealed to side panels 12, 14 by sealing layers 52, 54. Sealing layers 52, 54 are disposed between sealing flanges 27, 29 of closure profiles 22, 24 and side panels 12, 14. A slider device 30 is mounted on zipper closure 20.

Package 80 has a first peel seal 40 disposed between zipper closure 20 and package interior 11; first peel seal 40, in particular, is shown as first peel seal 45. First peel seal 45 is sealed to interior surface 15, specifically, to first and second side panels 12, 14. First peel seal 45 of package 80 is similar to first peel seal 40 of FIG. 3 except that in FIG. 3, first peel seal 40 is sealed to sealing flanges 27, 29. First peel seal 45 is sealed to side panels 12, 14 at outer surfaces 45*a*, 45*b*. This bond at outer surfaces 45*a*, 45*b* is greater than the internal strength of first peel seal 45; thus, failure of first peel seal 45 occurs within peel seal 45. Package 80 also includes a second peel seal 140 between distal flanges 127, 129. Second peel seal 140 is similar to the second peel seal 140 of FIG. 3.

The zipper closures 20, 20', 20" of the present disclosure are designed to be interchangeable among various types and sizes of packages. For example, the same zipper closure 20, 20', 20" can be used for packages that are hermetically sealed, packages that have a tamper-evident structure, and for packages that do not include a tamper-evident structure. In some embodiments, a tamper-evident pocket may be provided over slider device 30 to provide evidence whether slider device 30 has been moved. For packages where no peel seal is desired, the same zipper closure 20, 20' 20" can be used, simply without the peel seal being activated in the final package. Zipper closures 20, 20', 20" can be incorporated into packages which have the zipper closure positioned in a side panel of the package rather than at an edge; in these packages, zipper closure 20, 20', 20" may extend the entire length or width of the package or only partially.

Prior to being incorporated into a package, such as package 10, 60, 60', 70, 80 zipper closure 20, 20', 20" is preferably provided on a core, spool or otherwise stored. Closure profiles 22, 24 can be interlocked for storage, can be not interlocked, and can be provided on separate cores, spools, and the like.

Methods of Use

In order to open the reclosable flexible package 10, the consumer penetrates the first and second peel seals 40, 140 prior to or during the action of disengaging the first and second closure profiles 22, 24. Slider device 30 mounted on zipper closure 20 facilitates the penetration of second peel seal 140 as the slider device 30 moves from a first position to a second position along the zipper closure 20. After the second peel seal 140 is broken, the first and second closure profiles 22, 24 are disengaged, and the first peel seal 40 is exposed and broken. To accomplish this, the consumer grips the first closure profile 22 and the second closure profile 24 and pulls the first closure profile 22 and the second closure profile 24 apart such that the first peel seal 40 is broken.

The above specification is believed to provide a complete description of the manufacture and use of particular embodiments of the invention. Many embodiments of the invention can be made without departing from the spirit and scope of the invention.

I claim:

1. A flexible, reclosable package comprising:

(a) a package surrounding wall defining a package interior and having a mouth; the mouth providing access to the package interior; the surrounding wall includes a first side panel and a second side panel opposite the first side panel;

(b) a reclosable zipper along the mouth for selective opening and closing of the mouth; the zipper including:

(i) a first closure profile having a first sealing flange located at a first end of the first closure profile and a distal flange located at a second end of the first closure profile;

(ii) a second closure profile having a second sealing flange located at a first end of the second closure profile and a distal flange located at a second end of the second closure profile;

(iii) the first and second sealing flanges each having first and second surfaces;

(iv) a first sealant layer disposed on the first surface of the first sealing flange and secured to the first panel section, and a second sealant layer disposed on the first surface of the second sealing flange and secured to the second panel section;

(v) a first peel seal having first and second opposite outer surfaces;

(A) the first outer surface of the peel seal being secured to the second surface of the first sealing flange with a first seal strength;

(B) the second outer surface of the peel seal being secured to the second surface of the second sealing flange with a second seal strength; and (C) the first peel seal having an internal breaking strength that is less than each of the first seal strength and the second seal strength;

(vi) a second peel seal having first and second opposite outer surfaces;

(A) the first outer surface of the peel seal being secured to the distal flange of the first closure profile with a first seal strength;

(B) the second outer surface of the peel seal being secured to the distal flange of the second closure profile with a second seal strength; and (C) the second peel seal having an internal breaking strength that is less than each of the first seal strength and the second seal strength; and (c) a slider device operably mounted onto the reclosable zipper, the slider device interlocking the first closure profile with the second closure profile when the slider device is moved in a first direction, and disengaging the first closure profile from the second closure profile when the slider device is moved in a second opposite direction.

2. The flexible, reclosable package according to claim 1, wherein the first peel seal is a peelable film.

3. The flexible, reclosable package according to claim 2, wherein the first peelable film is a multi-layered film.

4. The flexible, reclosable package according to claim 3, wherein the multi-layered film has at least 2 layers.

5. The flexible, reclosable package according to claim 1, wherein the first sealant layer provides a hinge between the first closure profile and the first panel section.

6. The flexible, reclosable package according to claim 1, wherein the second peel seal is a peelable film.

7. The flexible, reclosable package according to claim 6, wherein the second peelable film is a multi-layered film.

8. The flexible, reclosable package according to claim 7, wherein the multi-layered film has at least 2 layers.

9. A flexible, reclosable package comprising:

(a) a package surrounding wall defining a package interior and having a mouth; the mouth providing access to the package interior; the surrounding wall includes a first side panel and a second side panel opposite the first side panel;

(b) a reclosable zipper along the mouth for selective opening and closing of the mouth; the zipper including:

(i) a first closure profile having a first sealing flange located at a first end of the first closure profile and a distal flange located at a second end of the first closure profile;

(ii) a second closure profile having a second sealing flange located at a first end of the second closure profile and a distal flange located at a second end of the second closure profile;

(iii) the first and second sealing flanges each having first and second surfaces;

(iv) a first sealant layer disposed on the first surface of the first sealing flange and secured to the first panel section, and a second sealant layer disposed on the first surface of the second sealing flange and secured to the second panel section;

(v) a first peel seal having first and second opposite outer surfaces;

(A) the first outer surface of the peel seal being secured to the first side panel with a first seal strength;

(B) the second outer surface of the peel seal being secured to the second side panel with a second seal strength; and (C) the first peel seal having an internal breaking strength that is less than each of the first seal strength and the second seal strength;

(vi) a second peel seal having first and second opposite outer surfaces;

(A) the first outer surface of the peel seal being secured to the distal flange of the first closure profile with a first seal strength;

(B) the second outer surface of the peel seal being secured to the distal flange of the second closure profile with a second seal strength; and (C) the second peel seal having an internal breaking strength that is less than each of the first seal strength and the second seal strength; and (c) a slider device operably mounted onto the reclosable zipper, the slider device interlocking the first closure profile with the second closure profile when the slider device is moved in a first direction, and disengaging the first closure profile from the second closure profile when the slider device is moved in a second opposite direction.

10. The flexible, reclosable package according to claim 9, wherein the first peel seal is a peelable film.

11. The flexible, reclosable package according to claim 10, wherein the first peelable film is a multi-layered film.

12. The flexible, reclosable package according to claim 11, wherein the multi-layered film has at least 2 layers.

13. The flexible, reclosable package according to claim 9, wherein the first sealant layer provides a hinge between the first closure profile and the first panel section.

14. The flexible, reclosable package according to claim 9, wherein the second peel seal is a peelable film.

15. The flexible, reclosable package according to claim 14, wherein the second peelable film is a multi-layered film.

16. The flexible, reclosable package according to claim 15, wherein the multi-layered film has at least 2 layers.

17. A zipper closure comprising:

(a) a first closure profile having a first sealing flange located at a first end of the first closure profile and a distal flange located at a second end of the first closure profile;

(b) a second closure profile having a second sealing flange located at a first end of the second closure profile and a distal flange located at a second end of the second closure profile;

(c) the first and second sealing flanges each having first and second surfaces;

(d) a first sealant layer disposed on the first surface of the first sealing flange and secured to the first panel section, and a second sealant layer disposed on the first surface of the second sealing flange and secured to the second panel section;

(e) a first peel seal having first and second opposite outer surfaces;

(i) the first outer surface of the peel seal being secured to the first side panel with a first seal strength;

(ii) the second outer surface of the peel seal being secured to the second side panel with a second seal strength; and (iii) the first peel seal having an internal breaking strength that is less than each of the first seal strength and the second seal strength;

(f) a second peel seal having first and second opposite outer surfaces;

(i) the first outer surface of the peel seal being secured to the distal flange of the first closure profile with a first seal strength;

(ii) the second outer surface of the peel seal being secured to the distal flange of the second closure profile with a second seal strength; and (iii) the second peel seal having an internal breaking strength that is less than each of the first seal strength and the second seal strength; and (c) a slider device operably mounted onto the reclosable zipper, the slider device interlocking the first closure profile with the second closure profile when the slider device is moved in a first direction, and disengaging the first closure profile from the second closure profile when the slider device is moved in a second opposite direction.

18. The flexible, reclosable package according to claim 17, wherein the first peel seal is a peelable film.

19. The flexible, reclosable package according to claim 18, wherein the first peelable film is a multi-layered film.

20. The flexible, reclosable package according to claim 19, wherein the multilayered film has at least 2 layers.

21. The flexible, reclosable package according to claim 17, wherein the second peel seal is a peelable film.

22. The flexible, reclosable package according to claim 21, wherein the second peelable film is a multi-layered film.

23. The flexible, reclosable package according to claim 22, wherein the multi-layered film has at least 2 layers.

24. A method of using a reclosable package comprising the step of:

(a) providing a package with an interior defined by a first side panel and a second side panel opposite the first side panel and having a mouth and a reclosable zipper arrangement for opening and closing the mouth; the zipper arrangement including;

(i) a first closure profile having a first sealing flange located at a first end of the first closure profile and a distal flange located at a second end of the first closure profile;

(ii) a second closure profile having a second sealing flange located at a first end of the second closure profile and a distal flange located at a second end of the second closure profile;

(iii) the first and second sealing flanges each having first and second surfaces;

(iv) a first sealant layer disposed on the first surface of the first sealing flange and secured to the first panel section, and a second sealant layer disposed on the first surface of the second sealing flange and secured to the second panel section;

(v) a first peel seal having first and second opposite outer surfaces;

(A) the first outer surface of the peel seal being secured to the second surface of the first sealing flange with a first seal strength;

(B) the second outer surface of the peel seal being secured to the second surface of the second sealing flange with a second seal strength; and (C) the first peel seal having an internal breaking strength that is less than each of the first seal strength and the second seal strength;

(vi) a second peel seal having first and second opposite outer surfaces;

(A) the first outer surface of the peel seal being secured to the distal flange of the first closure profile with a first seal strength;

(B) the second outer surface of the peel seal being secured to the distal flange of the second closure profile with a second seal strength; and (C) the second peel seal having an internal breaking strength that is less than each of the first seal strength and the second seal strength; and (c) a slider device operably mounted onto the reclosable zipper, the slider device interlocking the first closure profile with the second closure profile when the slider device is moved in a first direction, and disengaging the first closure profile from the second closure profile when the slider device is moved in a second opposite direction; and (b) penetrating the first and second peel seals.

25. The method according to claim 24 wherein the step of penetrating the second peel seal is preformed by the slider device as the slider device is moved in a second direction disengaging the first closure profile from the second closure profile.

* * * * *